US011615934B2

(12) United States Patent
Gass et al.

(10) Patent No.: US 11,615,934 B2
(45) Date of Patent: Mar. 28, 2023

(54) ELECTRONIC MINIATURE CIRCUIT BREAKER WITH ENHANCED DIAGNOSTIC USER INTERFACE

(71) Applicant: Schneider Electric USA, Inc., Boston, MA (US)

(72) Inventors: Randall James Gass, Cedar Rapids, IA (US); Joseph R. Beierschmitt, Marion, IA (US)

(73) Assignee: Schneider Electric USA, Inc., Boston, MA (US)

( * ) Notice: Subject to any disclaimer, the term of this patent is extended or adjusted under 35 U.S.C. 154(b) by 2 days.

(21) Appl. No.: 17/218,325

(22) Filed: Mar. 31, 2021

(65) Prior Publication Data

US 2022/0319790 A1 Oct. 6, 2022

(51) Int. Cl.
*H01H 71/04* (2006.01)
*H01H 9/16* (2006.01)

(52) U.S. Cl.
CPC ..... *H01H 71/04* (2013.01); *H01H 9/16* (2013.01); *H01H 2071/042* (2013.01)

(58) Field of Classification Search
CPC ..... H01H 9/16; H01H 71/04; H01H 2071/042
USPC ..... 361/115
See application file for complete search history.

(56) References Cited

U.S. PATENT DOCUMENTS

| | | | | |
|---|---|---|---|---|
| 8,243,411 | B2 | 8/2012 | Larson | |
| 8,503,148 | B2 | 8/2013 | Schroeder et al. | |
| 9,940,812 | B2 | 4/2018 | Schroeder et al. | |
| 10,283,299 | B2 | 5/2019 | Mittelstadt | |
| 10,514,419 | B2 | 12/2019 | Reid | |
| 10,852,355 | B2 | 12/2020 | Bernard | |
| 2005/0248897 | A1 | 11/2005 | Sadjadi | |
| 2018/0145497 | A1* | 5/2018 | Jakupi | H02H 3/05 |
| 2018/0149700 | A1* | 5/2018 | Bernard | G01R 31/52 |

* cited by examiner

*Primary Examiner* — Kevin J Comber
(74) *Attorney, Agent, or Firm* — Locke Lord LLP

(57) ABSTRACT

A method for identifying a type of fault condition with a circuit breaker includes detecting by the circuit breaker a fault condition of a plurality of fault conditions, storing in a memory device a trip code representing a type of the detected fault condition, interrupting current flow through the branch circuit in response to detecting the fault condition, and receiving a reset of the circuit breaker. The trip code may then be displayed in response to a momentary press of a test button that is a short duration press, and activating an LED interface in the circuit breaker to indicate the trip code representing the type of the detected fault condition.

15 Claims, 5 Drawing Sheets

ELECTRONIC MINIATURE CIRCUIT BREAKER WITH ENHANCED DIAGNOSTIC USER INTERFACE

TECHNICAL FIELD

The present disclosure is directed generally to circuit breakers, and, more particularly, to a method for indicating a type of trip condition.

BACKGROUND

Circuit breakers are conventionally used to protect electric power distribution circuits against arcing faults, ground faults, short circuit faults, and/or overloads.

Arcing faults are commonly defined as current through ionized gas between two ends of a broken conductor or at a faulty contact or connector, between two conductors supplying a load, or between a conductor and ground. A combination arc-fault circuit interrupter (CAFI) device provides protection against parallel arcing in a circuit, which occurs when electricity jumps the gap between wires of different voltages. In addition, the CAFI device provides protection against series arcing in the circuit, which occurs when electricity jumps the gap between the strands within the same wire. A dual function (DF) CAFI device adds a ground-fault circuit interrupter (GFCI) function, which provides protection against electrical shock from ground-faults, which occur when electrical current passes outside of the circuit wires and through an external object connected to ground. CAFI devices and GFCI devices are typically circuit interrupters that are designed to interrupt the electrical current, if an arc-fault or a ground-fault is detected.

Typically, miniature circuit breakers are used particularly to protect branch circuits in homes and in commercial and light industry applications. For example, the miniature circuit breakers utilize an arc fault detector, a ground fault detector, a magnetic armature that is responsive to large magnetic forces generated by a short-circuit current, and/or a thermo-magnetic trip device that incorporates a bimetal responsive to persistent overload conditions.

When a fault or overload condition is detected on the protected circuit, the circuit breaker is tripped to open separable contacts of the circuit breaker and, thus, interrupt current flow in the protected circuit. The status of the circuit breaker is typically indicated by the position of an actuating handle, which indicates whether the circuit breaker is in an ON position, OFF position, or TRIPPED position. However, when the circuit breaker is tripped, the position of the actuating handle does not indicate the type of fault that caused the trip condition. In other words, a user cannot determine whether the circuit breaker has been tripped based on an arcing fault condition, a ground fault condition, a short circuit fault condition, or an overload condition.

A circuit breaker diagnostic feature is described in U.S. Pat. No. 8,243,411 to Brett Larson (the "Larson patent"), entitled "Electronic Miniature Circuit Breaker With Trip Indication Using The Breaker Tripping Function As The Feedback Mechanism", the disclosure of which is incorporated herein by reference. In one embodiment of the Larson patent, a circuit breaker is configured to convey diagnostic information concerning a prior occurrence of a trip event, such as a type of fault condition, by implementing a trip sequence (or indication) as a function of time during a read out operation. For example, an arc fault condition is indicated by having the circuit breaker trip after a certain time delay (e.g., the handle is moved to an ON position and then to the TRIPPED position after a delay of two seconds), and a ground fault condition is indicated by having the circuit breaker trip after another certain time delay (e.g., the handle is moved to an ON position and then to the TRIPPED position after a delay of four seconds), wherein contacts of the circuit breaker are closed in the ON position and are opened in the TRIPPED position.

While the circuit breaker diagnostic feature of the Larson patent does not result in any additional cost or add significant complexity to the circuit breaker, it may be difficult for some users to distinguish between different indication time periods of a trip sequence during a read out operation. The movement of the circuit breaker handle to the tripped position may also confuse users with little or no technical experience during the read out operation. Furthermore, by relying on human senses to determine an indication time period of the trip sequence during the read out operation, the circuit breaker may be limited in a number of types of fault conditions conveyable as a function of time since, humans cannot easily distinguish time periods that differ in the seconds to sub-second range. Also, the circuit breaker diagnostic feature of the Larson patent requires the user to disrupt power to the circuit to activate the diagnostic function, causing unnecessary start/stop stress to down-stream loads in the branch circuit. Moreover, for a load center containing many circuit breakers, a first person may reset the tripped breaker without invoking the diagnostic feature or noting which breaker in the load center has tripped. Then, if a second person seeks to learn why a tripping event occurred, the second person must switch-off and switch-on several circuit breakers in the load center in order to activate the diagnostic feature for the circuit breaker has previously tripped.

What is needed, therefore, is an enhanced diagnostic feature that will allow the user to display a stored trip code without disrupting power to the circuit breaker.

SUMMARY

An enhanced diagnostic method identifies a type of fault condition in a circuit breaker. The method includes detecting by the circuit breaker a fault condition of a plurality of fault conditions, storing in a memory device a trip code representing a type of the detected fault condition, interrupting current flow through the branch circuit in response to detecting the fault condition, and receiving a reset of the circuit breaker. The trip code may then be displayed in response to a momentary press of a test button that is a short duration press, and activating an LED interface in the circuit breaker to indicate the trip code representing the type of the detected fault condition. Alternately, a self-test of the circuit breaker may be performed in response to a momentary press of the test button that is a longer duration than the short duration. The enhanced diagnostic feature allows the user to display the stored trip code without cycling power to the circuit breaker, by activating the LED interface without tripping the circuit breaker.

In accordance with one example embodiment described herein, a method for identifying a type of fault condition in a circuit breaker, comprises:

- monitoring, by the circuit breaker, a branch circuit for occurrences of fault conditions;
- detecting, by the circuit breaker, a fault condition of a plurality of fault conditions;
- storing, in a memory device of the circuit breaker, a trip code representing a type of the detected fault condition;

interrupting, by the circuit breaker, current flow through the branch circuit in response to detecting the fault condition;

receiving a reset of the circuit breaker;

receiving an indication of a press of a test button on the circuit breaker; and responsive to receiving the indication and upon determining that the press of the test button was for a short duration, retrieving the trip code from the memory device representing the type of the detected fault condition, and activating a light-emitting diode (LED) interface in the circuit breaker in a manner that indicates the trip code representing the type of the detected fault condition.

In accordance with one example embodiment described herein, the method further comprises:

alternately, performing a self-test on the circuit breaker in response to the momentary press of the test button being a longer duration than the short duration.

In accordance with one example embodiment described herein, wherein the plurality of different types of fault conditions includes at least one of an instantaneous fault condition, an arc fault condition, or a ground fault condition.

In accordance with one example embodiment described herein, the method further comprises:

receiving programmed instructions in the circuit breaker to detect another type of fault condition in the branch circuit;

setting another trip code in the circuit breaker that represents the another type of fault condition; and setting a parameter in the LED interface to indicate detection of the another type of fault condition.

In accordance with one example embodiment described herein, wherein the trip code retrieved from the memory device is in response to the short duration press on a push-to-test (PTT) button on the circuit breaker.

In accordance with one example embodiment described herein, the method further comprises:

receiving a plurality of consecutive short duration taps of the test button on the circuit breaker, the number of consecutive short duration taps indicating different modes of operation or different modes of display of the type of the detected fault.

The resulting method, apparatus and system allows the user to display the stored trip code without cycling power to the circuit breaker.

BRIEF DESCRIPTION OF THE DRAWINGS

A more detailed description of the disclosure, briefly summarized above, may be had by reference to various embodiments, some of which are illustrated in the appended drawings. While the appended drawings illustrate select embodiments of this disclosure, these drawings are not to be considered limiting of its scope, for the disclosure may admit to other equally effective embodiments.

DETAILED DESCRIPTION

Figure 1:
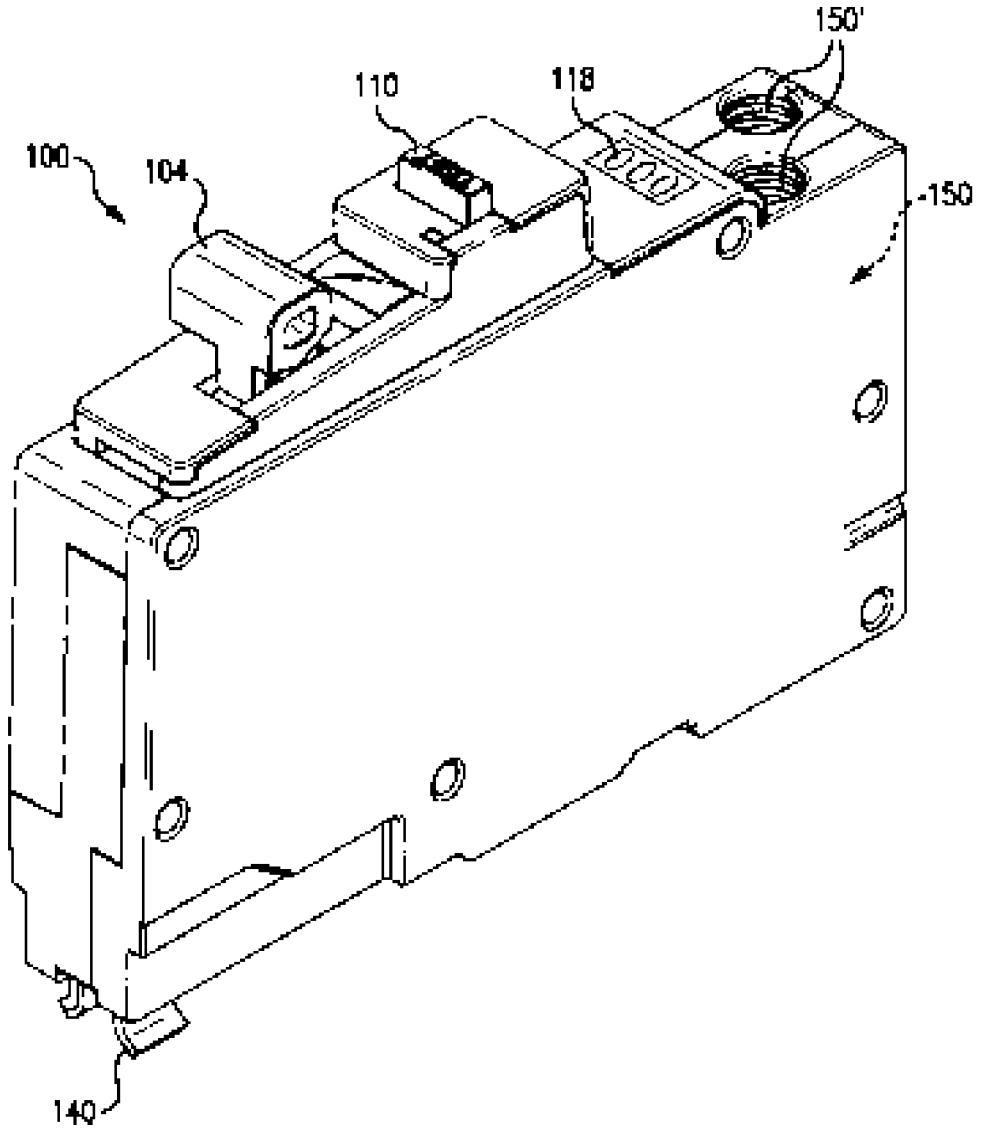
FIG. 1 is a perspective view of a circuit breaker, according to an embodiment of the disclosure.

An example circuit breaker 100 of FIG. 1 may be a dual function combination arc-fault circuit interrupter and ground-fault circuit interrupter (DF/CAFI). The circuit breaker 100 has a latching mechanism 102 (FIG. 2) and a handle 104. The latching mechanism 102 is used to automatically separate a pair of separable (or main) contacts 106, 108 (FIG. 2) when a certain fault condition occurs. The line terminals of the circuit breaker 100 may be connected to a branch power line 140 and load terminals may be connected to a load 150 by means of fasteners 150'. The handle 104 is used to manually open and close the separable contacts 106, 108, and is movable between a number of circuit breaker positions, including an ON position, an OFF position, and a TRIPPED position.

In the ON position, the separable contacts 106, 108 are closed to allow current flow through the protected branch circuit. The physical position of the handle 104 is in the ON position. In an alternate embodiment, a motor or actuator (not shown) in the circuit breaker 100, may be remotely controlled to mechanically close the contacts 106, 108 to allow current flow through the protected branch circuit.

In the OFF position, the separable contacts 106, 108 are open to prevent current flow through the protected branch circuit. Typically, the OFF position indicates a manual separation of the separable contacts 106, 108. The physical position of the handle 104 is in the OFF position. In the alternate embodiment, the motor or actuator (not shown) in the circuit breaker 100, may be remotely controlled to mechanically open the contacts 106, 108 to prevent current flow through the protected branch circuit.

In the TRIPPED position, the separable contacts 106, 108 are open to prevent current flow through the protected branch circuit (similar to the OFF position). Typically, the TRIPPED position indicates an automatic separation of the separable contacts 106, 108. The physical position of the handle 104 in the TRIPPED position is between the ON position and the OFF position.

Figure 2:
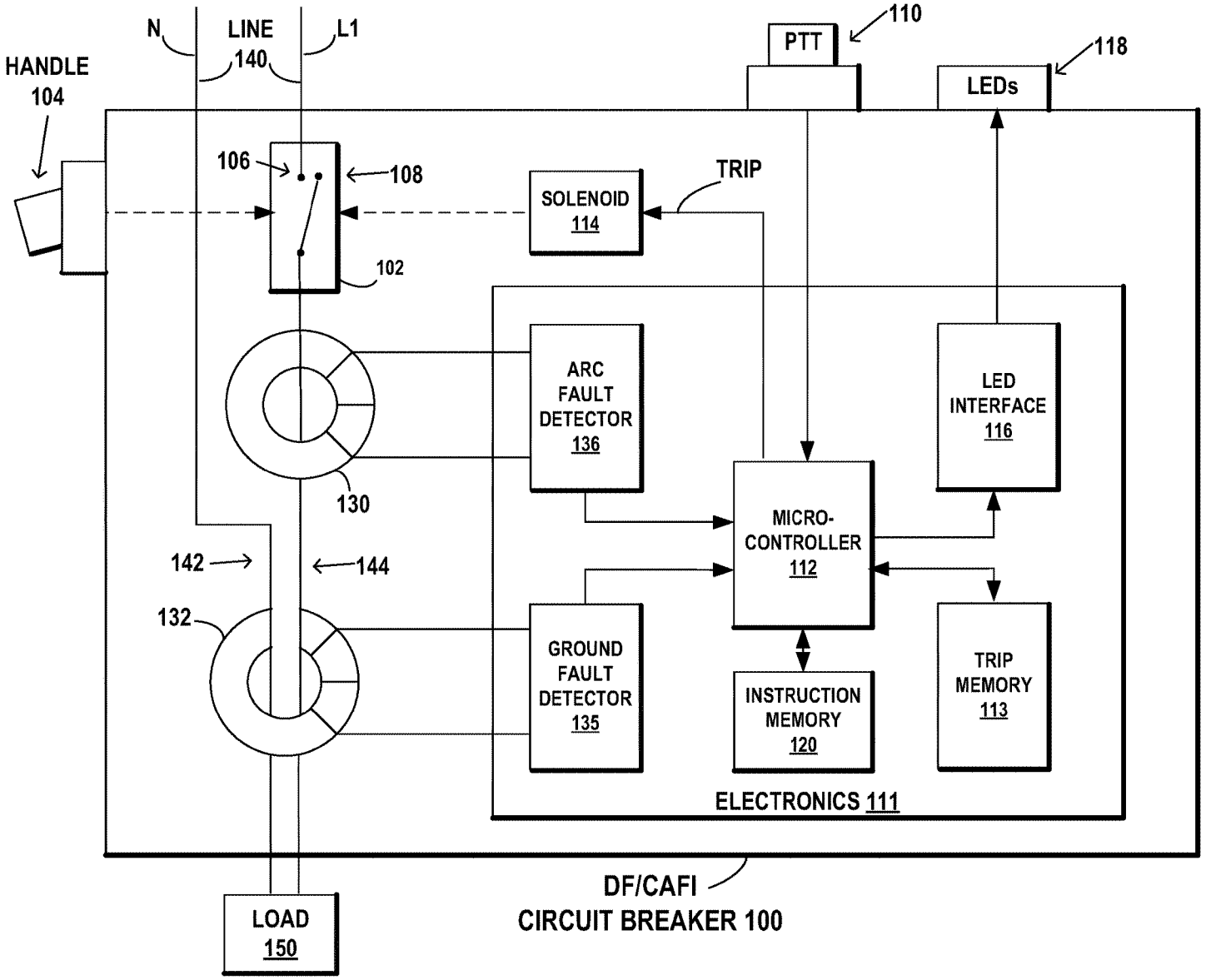
FIG. 2 is a circuit and functional block diagram of the circuit breaker of FIG. 1, according to an embodiment of the disclosure.

The electronics module 111 includes a processor or microcontroller 112 (FIG. 2) with a non-volatile memory 113 (FIG. 2). The electronics module 111 monitors the branch circuit to determine any occurrences of fault conditions. The fault conditions may be of different types, including, for example, an arc fault condition, a short circuit condition, or a ground fault condition. If any fault condition occurs, the microcontroller 112 sends a signal to a trip solenoid 114 (FIG. 2) to open the separable contacts 106, 108. The opening of the separable contacts 106, 108 interrupts current flowing in the branch circuit.

When a fault condition occurs, the circuit breaker 100 is tripped and the handle 104 is automatically moved to the TRIPPED position. In the TRIPPED position, the handle 104 is automatically positioned between the ON position and the OFF position to indicate visually that a fault condition has occurred. The type of fault condition is stored in the memory device 113, which may be a non-volatile memory of the electronics module 111. After the circuit breaker has tripped, the user may reset the separable contacts 106, 108 to be closed by moving the physical position of the handle 104 from the TRIPPED position to the ON position.

To determine the type of fault condition that has caused the separable contacts 106, 108 to be opened, a user applies a momentary press to a push-to-test (PTT) button 110. If the momentary press of the test button 110 is a short duration tap, for example less than 250 milliseconds, the microcontroller 112 retrieves the stored trip code representing the detected type of fault condition from the memory device 113 and activates an LED interface 116 (FIG. 2) to illuminate LED devices 118 on circuit breaker to indicate the detected type of fault condition by displaying an indication of the stored trip code. The separable contacts 106, 108 remain closed and the circuit breaker handle 104 remains in the ON position.

Alternately, if the momentary press of the test button is a longer duration, for example greater than 250 milliseconds, which is longer than the short duration tap, the microcontroller 112 performs a self-test of the electronics module 111. If the self-test is passed, the microcontroller 112 signals the trip solenoid 114 to open the separable contacts 106, 108, to thereby indicate the successful completion of the test. The handle 104 is automatically moved to the TRIPPED position. If the electronics module 111 fails the test, the circuit breaker 100 is not tripped, which indicates that a problem may exist.

FIG. 2 is a circuit and functional block diagram of the circuit breaker of FIG. 1. The line terminals of the circuit breaker 100 may be connected to a 120 volt AC, 60 Hz branch power line 140 comprising an L1 120 volt line and a grounded neutral voltage N line. The L1 line may be connected through the contacts 106, 108 and line 144 to load terminals to supply 120 VAC to load 150, such as a household lighting circuit line. The grounded neutral voltage N line is connected via line 142 to load terminals to provide the grounded neutral voltage connection to load 150. The latching mechanism 102, discussed above, maintains the contacts 106, 108 closed in the ON position to conduct current. The latching mechanism 102 separates the pair of separable contacts 106, 108 when a fault condition occurs.

The circuit breaker 100 may include a current transformer 130 having the electric power line or branch line 144 serving as its primary. The secondary coil of the current transformer 130 is connected to a sensor input terminal of an arc fault detector 136 in the electronics module 111. The arc fault detector 136 outputs signals to the microcontroller 112 when an arc fault is detected on branch line 144. The microcontroller 112 stores the trip code in the memory 113 representing the detected fault condition. The microcontroller 112 then sends a trip signal to solenoid 114 to cause the latching mechanism 102 to separate the pair of separable contacts 106, 108.

The arc fault detector 136 and microcontroller 112 analyze the current and rise time (di/dt) signals detected by the current transformer 130. By means of an arc-fault detection algorithm, the microcontroller 112 may make a trip decision, using the presence of broadband noise and the current peaks and current rise time (di/dt), enabling the detection of arcing faults, short circuit faults, and overload conditions. The microcontroller 112 stores respective trip codes in the trip memory 113 for each type of fault detected.

The microcontroller 112 may be programmed to perform other diagnostics to detect other types of fault conditions and set other trip codes that represent the other types of fault conditions. For example, another type of fault condition may be detecting when inrush currents to an induction motor last too long or are excessive. When the microcontroller 112 is programmed to detect other kinds of fault conditions and represents them with other corresponding trip codes, the microcontroller 112 sets corresponding parameters in the LED interface 116 to display distinctive illumination patterns representing the other types of fault conditions. One example arc-fault detection algorithm is described in U.S. Pat. No. 6,259,996, issued Jul. 10, 2001, the disclosure of which is incorporated herein by reference.

Figure 4A:
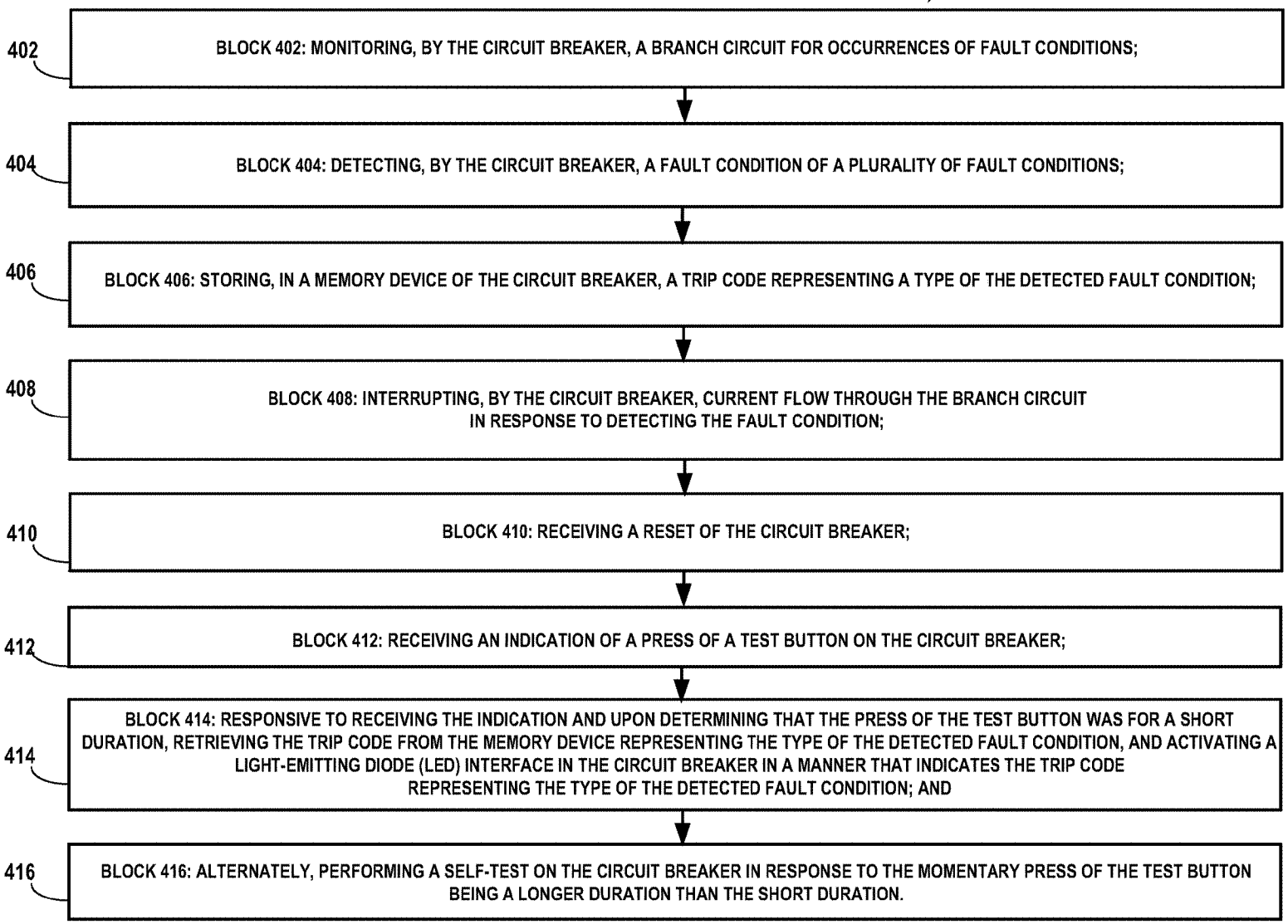
FIG. 4A is an example flow diagram 400 of a method performed by the example microcontroller of FIG. 2, to perform the enhanced diagnostic method, according to an embodiment of the disclosure.
Figure 4B:
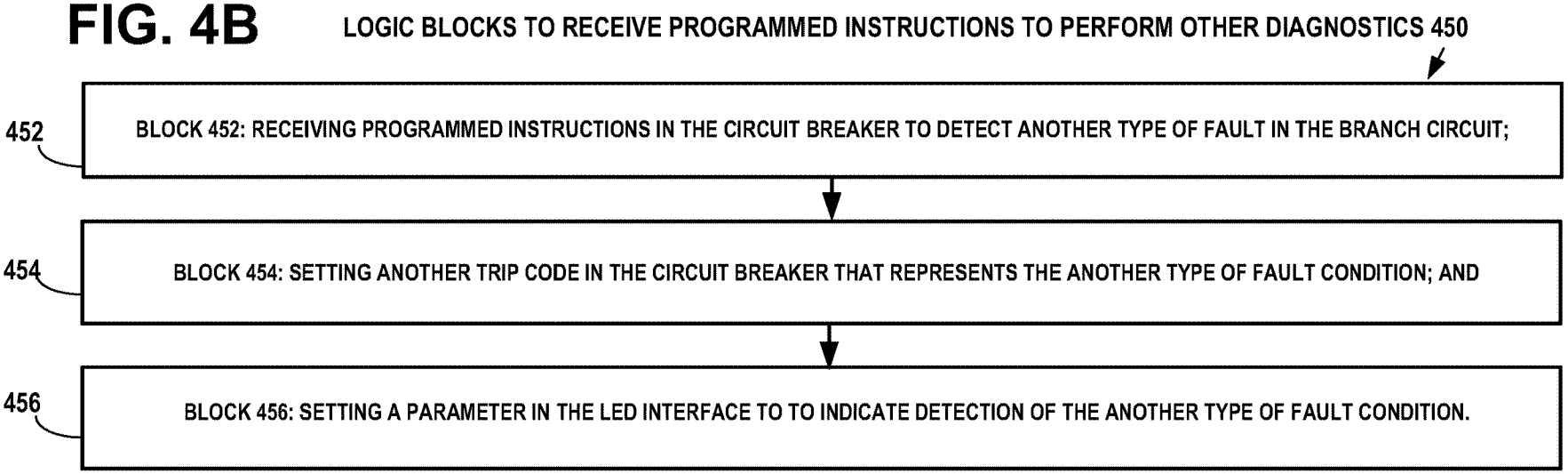
FIG. 4B is an example flow diagram 450 of a method performed by the example microcontroller of FIG. 2, to receive programmed instructions to perform other diagnostics to detect other types of fault conditions, according to an embodiment of the disclosure.

An example flow diagram 450 of FIG. 4B describes a method performed by the example microcontroller of FIG. 2, to receive programmed instructions to perform other diagnostics. The flow diagram of FIG. 4B also describes a corresponding computer program product. The flow diagram includes logic blocks that may be implemented by computer program instructions stored in the instruction memory 120 and executed by the microcontroller 112 in the circuit breaker 100 of FIG. 2. Alternately, the logic blocks may also be implemented by computer hardware logic in the circuit breaker 100 of FIG. 1, which can carry out the functions specified by the logic blocks.

The method performed by the logic blocks to receive programmed instructions to perform other diagnostics, comprises:

Block 452: receiving programmed instructions in the circuit breaker to detect another type of fault condition in the branch circuit;

Block 454: setting another trip code in the circuit breaker that represents the another type of fault condition; and Block 456: setting a parameter in the LED interface to indicate detection of the another type of fault condition.

The circuit breaker 100 may also include a ground-fault current transformer 132 having both power lines 142 and 144 serving as its primary and having its secondary coil connected to the input of a ground fault detector 135 in the electronics module 111. The ground-fault current transformer 132 senses when the currents in the power lines 142 and 144 are not the same magnitude, and outputs a signal to the ground fault detector 135. The ground fault detector 135 outputs signals to the microcontroller 112 when a ground fault is detected for lines 142 and 144. The microcontroller 112 then sends a trip signal to solenoid 114 to cause the latching mechanism 102 to separate the pair of separable contacts 106, 108.

When a fault condition occurs, the type of fault condition is stored as a trip code in the memory device 113, which may be a non-volatile memory of the electronics module 111. The circuit breaker 100 is tripped and the handle 104 is automatically moved to the TRIPPED position. After the circuit breaker has tripped, the user may reset the separable contacts 106, 108 to be closed by moving the physical position of the handle 104 from the TRIPPED position to the ON position.

To determine the type of fault condition that has caused the separable contacts 106, 108 to be opened, a user applies a momentary press to the push-to-test (PTT) button 110. If the momentary press of the test button 110 is a short duration tap, for example less than 250 milliseconds, the microcontroller 112 retrieves the stored trip code representing the detected type of fault condition from the memory device 113 and activates an LED interface 116 to illuminate LED devices 118 on circuit breaker to indicate the detected type of fault condition by displaying an indication of the stored trip code. Examples of distinctive indications of the trip code may include color LEDs, multiple LEDs, varying flash patterns for the LEDs such as slow to fast. A sound annunciator, beeper, or buzzer may also be used to draw the user's attention to the affected circuit breaker. As an example of distinctive indications of the trip code, an LED may remain on for five seconds to represent an arc fault. A ground fault may be represented by two blinks and a ground neutral by four blinks. Other diagnostics may be represented by seven blinks. The separable contacts 106, 108 may remain closed and the circuit breaker handle 104 may remain in the ON position, while the LEDs are illuminated.

Alternately, if the momentary press of the test button 110 is a longer duration, for example greater than 250 milliseconds, which is longer than the short duration tap, the microcontroller 112 performs a self-test of the electronics module 111. If the self-test is passed, the microcontroller 112 signals the trip solenoid 114 to open the separable contacts 106, 108, to thereby indicate the successful completion of the test. The handle 104 is automatically moved to the TRIPPED position. Alternately, if the electronics module 111 fails the test, the circuit breaker 100 is not tripped, which indicates that a problem may exist.

In another alternate embodiment, instead of a single momentary press of the test button 110, the user may apply multiple short duration taps that are programmed to indicate a different mode of operation or a different display mode than that of using the LED s 118. A plurality of consecutive short duration taps may be received by the test button on the circuit breaker, the number of consecutive short duration taps indicating different modes of operation or different modes of display of the type of the detected fault. For example, alternate display modes may include the transmission of an electrical or wireless signal to a remote receiver, indicating the type of fault and the identity of the particular circuit breaker or branch circuit experiencing the fault. An example of a different mode of operation may be, in the event of detecting an arc fault, transmitting an alarm signal by means of electrical or wireless transmission, to alert an upstream power distribution hub to divert power from the branch circuit being monitored, until the reason for the detected arc fault can be repaired.

Figure 3:
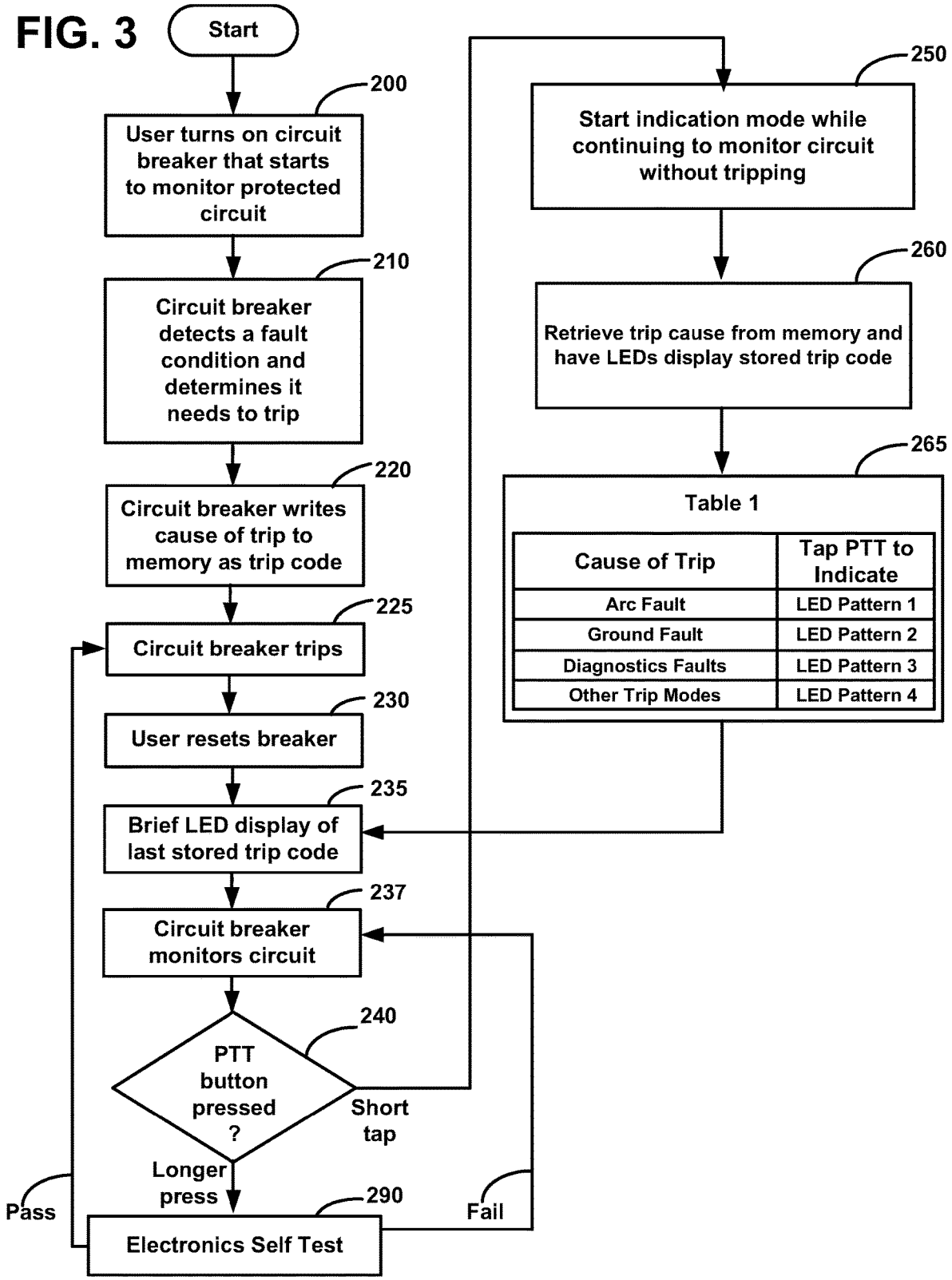
FIG. 3 is a flowchart illustrating a method of the enhanced diagnostic feature for indicating a trip condition in the circuit breaker of FIGS. 1 and 2, according to an embodiment of the disclosure.

Referring to FIG. 3, the enhanced diagnostic method includes (200) turning a circuit breaker ON to begin monitoring the protected circuit. Upon detecting a fault condition, a determination is made that the circuit breaker must be TRIPPED (210). Accordingly, the circuit breaker writes the cause of the trip to non-volatile memory (220) as a trip code. The circuit breaker then trips (225). The user may reset the circuit breaker (230), for example, by manually moving the handle of the circuit breaker to the ON position. The circuit breaker then briefly displays with the LEDs 118 the last stored trip code (235). The circuit breaker continues to monitor the circuit (237).

To determine the type of fault condition that has caused the separable contacts 106, 108 to be opened, the user applies a momentary press to the push-to-test (PTT) button 110. (240) If the momentary press of the test button 110 is a short duration tap, for example less than 250 milliseconds, an indication mode is started (250) while continuing to monitor the circuit without tripping. The microcontroller 112 retrieves the stored trip code (260) representing the detected type of fault condition from the memory device 113. The microcontroller activates the LED interface 116 to illuminate LED devices 118 on circuit breaker to indicate the detected type of fault condition by displaying an indication of the stored trip code (265, Table 1). The separable contacts 106, 108 remain closed and the circuit breaker handle 104 remains in the ON position.

The indication mode (250) generates an indication signal and sends it to the LED interface 116. The indication signal causes the LED interface 116 to illuminate the LEDs 118 to display an indication of the stored trip code, without disrupting power to the circuit breaker, in accordance with programmable parameters set in Table 1 (265). For example, if the type of fault condition was an "Arc Fault" that occurred, the LED devices display a pattern 1. If the type of fault condition was a "Ground Fault", the LED devices display a pattern 2. If the type of fault condition was a "Diagnostics Fault," the LED devices display a pattern 3. Other trip modes may be programmed, as previously described, which may be represented by the LED devices display a pattern 4. Grounded Neutral (GN) faults may also be displayed by distinctive patterns of illumination of the LED devices. One or more LED devices 118 or other patterns of illumination may be used for the LED devices 118, to indicate the trip codes for corresponding types of fault conditions.

TABLE 1

| Cause of Trip | Push to Indicate |
|---|---|
| Arc Fault | LED Pattern 1 |
| Ground Fault | LED Pattern 2 |
| Diagnostics Fault | LED Pattern 3 |
| Other Trip Modes | LED Pattern 4 |

If the circuit breaker is ON, the enhanced diagnostic feature keeps the circuit breaker ON and continues to monitor the protected circuit (237) without cycling the power, while the LEDs 118 may display the indication of the stored trip code.

An example flow diagram 400 of FIG. 4A describes a method performed by the example microcontroller of FIG. 2, to perform the enhanced diagnostic method. The flow diagram of FIG. 4A also describes a corresponding computer program product. The flow diagram includes logic blocks that may be implemented by computer program instructions stored in the instruction memory 120 and executed by the microcontroller 112 in the circuit breaker 100 of FIG. 2. Alternately, the logic blocks may also be implemented by computer hardware logic in the circuit breaker 100 of FIG. 1, which can carry out the functions specified by the logic blocks.

The method performed by the logic blocks for the enhanced diagnostic method, comprises:

- Block 402: monitoring, by the circuit breaker, a branch circuit for occurrences of fault conditions;
- Block 404: detecting, by the circuit breaker, a fault condition of a plurality of fault conditions;
- Block 406: storing, in a memory device of the circuit breaker, a trip code representing a type of the detected fault condition;
- Block 408: interrupting, by the circuit breaker, current flow through the branch circuit in response to detecting the fault condition;
- Block 410: receiving a reset of the circuit breaker;
- Block 412: receiving an indication of a press of a test button on the circuit breaker;
- Block 414: responsive to receiving the indication and upon determining that the press of the test button was for a short duration, retrieving the trip code from the memory device representing the type of the detected fault condition, and activating a light-emitting diode (LED) interface in the circuit breaker in a manner that indicates the trip code representing the type of the detected fault condition; and
- Block 416: alternately, performing a self-test on the circuit breaker in response to the momentary press of the test button being a longer duration than the short duration.

The resulting method, apparatus and computer program product allows the user to display the stored trip code without cycling power to the circuit breaker.

In the preceding, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The various embodiments disclosed herein may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "component", "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

What is claimed is:

1. A method for identifying a type of fault condition in a circuit breaker, the circuit breaker being configured to receive a single short duration tap of a test button on the circuit breaker and a plurality of consecutive short duration taps of the test button on the circuit breaker, the number of consecutive short duration taps indicating different modes of display of a detected fault condition, the method comprising:

monitoring, by the circuit breaker, a branch circuit for occurrences of fault conditions;

detecting, by the circuit breaker, a fault condition of a plurality of fault conditions;

storing, in a memory device of the circuit breaker, a trip code representing a type of the detected fault condition;

interrupting, by the circuit breaker, current flow through the branch circuit in response to detecting the fault condition;

receiving a reset of the circuit breaker;

receiving the single short duration tap of the test button on the circuit breaker or the plurality of consecutive short duration taps of the test button on the circuit breaker;

responsive to receiving the single short duration tap of the test button, retrieving the trip code from the memory device representing the type of the detected fault condition, and activating a light-emitting diode (LED) interface in the circuit breaker in a manner that indicates the trip code representing the type of the detected fault condition; and responsive to receiving the plurality of consecutive short duration taps of the test button, retrieving the trip code from the memory device representing the type of the detected fault condition, and displaying the detected fault condition according to a display mode determined based on the number of consecutive short duration taps in the plurality of consecutive short duration taps.

2. The method of claim 1, further comprising:

alternately, performing a self-test on the circuit breaker in response to a momentary press of the test button being a longer duration than the single short duration tap.

3. The method of claim 1, wherein the plurality of different types of fault conditions includes at least one of an instantaneous fault condition, an arc fault condition, or a ground fault condition.

4. The method of claim 3, further comprising:

receiving programmed instructions in the circuit breaker to detect another type of fault condition in the branch circuit;

setting another trip code in the circuit breaker that represents the another type of fault condition; and setting a parameter in the LED interface to indicate detection of the another type of fault condition.

5. The method of claim 1, wherein the trip code retrieved from the memory device is in response to the single short duration tap or the plurality of consecutive short duration taps on a push-to-test (PTT) button on the circuit breaker.

6. A computer program product for identifying a type of fault condition in a circuit breaker, comprising computer executable program code recorded on a computer readable non-transitory storage medium, the computer executable program code comprising:

code for monitoring, by the circuit breaker, a branch circuit for occurrences of fault conditions;

code for detecting, by the circuit breaker, a fault condition of a plurality of fault conditions;

code for storing, in a memory device of the circuit breaker, a trip code representing a type of the detected fault condition;

code for interrupting, by the circuit breaker, current flow through the branch circuit in response to detecting the fault condition;

code for receiving a reset of the circuit breaker;

code for receiving a single short duration tap of a test button on the circuit breaker code for receiving a plurality of consecutive short duration taps of the test button on the circuit breaker, the number of consecutive short duration taps indicating different modes of display of the detected fault condition;

code for responsive to receiving the single short duration tap of the test button, retrieving the trip code from the memory device representing the type of the detected fault condition, and activating a light-emitting diode (LED) interface in the circuit breaker in a manner that indicates the trip code representing the type of the detected fault condition; and code for responsive to receiving the plurality of consecutive short duration taps of the test button, retrieving the trip code from the memory device representing the type of the detected fault condition, and displaying the detected fault condition according to a display mode determined based on the number of consecutive short duration taps in the plurality of consecutive short duration taps.

7. The computer program product of claim 6, further comprising:

code for alternately, performing a self-test on the circuit breaker in response to a momentary press of the test button being a longer duration than the single short duration tap.

8. The computer program product of claim 6, wherein the plurality of different types of fault conditions includes at least one of an instantaneous fault condition, an arc fault condition, or a ground fault condition.

9. The computer program product of claim 8, further comprising:

code for receiving programmed instructions in the circuit breaker to detect another type of fault condition in the branch circuit;

code for setting another trip code in the circuit breaker that represents the another type of fault condition; and code for setting a parameter in the LED interface to indicate detection of the another type of fault condition.

10. The computer program product of claim 6, wherein the trip code retrieved from the memory device is in response to the single short duration tap or the plurality of consecutive short duration taps on a push-to-test (PTT) button on the circuit breaker.

11. An apparatus for identifying a type of fault condition in a circuit breaker, the apparatus being configured to receive a single short duration tap of a test button on the circuit breaker and a plurality of consecutive short duration taps of the test button on the circuit breaker, the number of consecutive short duration taps indicating different modes of display of a detected fault condition, the apparatus comprising:

at least one processor;

at least one memory including computer program code, wherein the computer program code, when executed by operation of the at least one processor, causes the apparatus at least to perform:

monitoring, by the circuit breaker, a branch circuit for occurrences of fault conditions;

detecting, by the circuit breaker, a fault condition of a plurality of fault conditions;

storing, in a memory device of the circuit breaker, a trip code representing a type of the detected fault condition;

interrupting, by the circuit breaker, current flow through the branch circuit in response to detecting the fault condition;

receiving a reset of the circuit breaker;

receiving the single short duration tap of a test button on the circuit breaker or the plurality of consecutive short duration taps of the test button on the circuit breaker;

responsive to receiving the single short duration tap of the test button, retrieving the trip code from the memory device representing the type of the detected fault condition, and activating a light-emitting diode (LED) interface in the circuit breaker in a manner that indicates the trip code representing the type of the detected fault condition; and responsive to receiving the plurality of consecutive short duration taps of the test button, retrieving the trip code from the memory device representing the type of the detected fault condition, and displaying the detected fault condition according to a display mode determined based on the number of consecutive short duration taps in the plurality of consecutive short duration taps.

12. The apparatus of claim 11, wherein the computer program code, when executed by operation of the at least one processor, performs an operation further comprising:

alternately, performing a self-test on the circuit breaker in response to a momentary press of the test button being a longer duration than the single short duration tap.

13. The apparatus of claim 11, wherein the plurality of different types of fault conditions includes at least one of an instantaneous fault condition, an arc fault condition, or a ground fault condition.

14. The apparatus of claim 13, wherein the computer program code, when executed by operation of the at least one processor, performs an operation further comprising:

receiving programmed instructions in the circuit breaker to detect another type of fault condition in the branch circuit;

setting another trip code in the circuit breaker that represents the another type of fault condition; and setting a parameter in the LED interface to indicate detection of the another type of fault condition.

15. The apparatus of claim 11, wherein the trip code retrieved from the memory device is in response to the single short duration tap or the plurality of consecutive short duration taps on a push-to-test (PTT) button on the circuit breaker.

* * * * *